US006898824B2

(12) United States Patent
Zaltron

(10) Patent No.: US 6,898,824 B2
(45) Date of Patent: May 31, 2005

(54) STICK WITH SHOCK-ABSORBER

(76) Inventor: Renato Zaltron, Via della Madonetta, 16, 36060-Romano d'Ezzelino (IT)

( * ) Notice: Subject to any disclaimer, the term of this patent is extended or adjusted under 35 U.S.C. 154(b) by 349 days.

(21) Appl. No.: 09/760,567

(22) Filed: Jan. 16, 2001

(65) Prior Publication Data

US 2001/0011817 A1 Aug. 9, 2001

(30) Foreign Application Priority Data

Jan. 21, 2000 (IT) ..... VI2000A0016

(51) Int. Cl.[7] ..... A45B 9/02
(52) U.S. Cl. ..... 16/430; 135/66; 403/377
(58) Field of Search ..... 16/430; 188/266, 188/297; 267/152–154; 135/66, 82, 68; 403/377, 378, 379, 348, 349; 280/821, 819; 482/74

(56) References Cited

U.S. PATENT DOCUMENTS

| | | | | | |
|---|---|---|---|---|---|
| 619,235 | A | * | 2/1899 | Schwarting | 135/80 |
| 2,667,885 | A | * | 2/1954 | Prete | 135/81 |
| 2,820,655 | A | * | 1/1958 | Hileman | 287/53 |
| 3,730,544 | A | * | 5/1973 | Hyman | 280/819 |
| 3,901,258 | A | * | 8/1975 | Montgomery | 135/68 |
| 4,073,858 | A | * | 2/1978 | Chung | 264/262 |
| 4,244,602 | A | * | 1/1981 | Allsop et al. | 280/821 |
| 4,448,442 | A | * | 5/1984 | Weber-Henning et al. | 280/823 |
| 4,472,953 | A | * | 9/1984 | Gater | 70/373 |
| 5,114,186 | A | * | 5/1992 | Sugiyama | 280/821 |
| 5,292,123 | A | * | 3/1994 | Schmidt, Jr. et al. | 273/80.2 |
| 5,443,435 | A | * | 8/1995 | Wilkinson | 482/74 |
| 5,513,622 | A | * | 5/1996 | Musacchia, Sr. | 124/89 |
| 5,871,222 | A | * | 2/1999 | Webb | 280/511 |
| 6,007,268 | A | * | 12/1999 | Whittington et al. | 403/328 |
| 6,102,381 | A | * | 8/2000 | Fischer | 267/154 |
| 6,131,592 | A | * | 10/2000 | Panizza | 135/66 |
| 6,254,134 | B1 | * | 7/2001 | Panizza | 280/819 |
| 6,311,962 | B1 | * | 11/2001 | Marking | 267/64.25 |
| 6,328,294 | B1 | * | 12/2001 | Palinkas | 267/153 |
| 6,379,076 | B1 | * | 4/2002 | Reinhold et al. | 403/348 |

FOREIGN PATENT DOCUMENTS

| | | | | |
|---|---|---|---|---|
| FR | 2617023 | * | 12/1988 | 135/67 |

* cited by examiner

*Primary Examiner*—Heather Shackelford
*Assistant Examiner*—Michael J. Kyle
(74) *Attorney, Agent, or Firm*—R. Neil Sudol; Henry D. Coleman; William J. Sapone

(57) ABSTRACT

A stick with shock-absorber including: an elongated member associated with a movable member with the interposition of a shock-absorbing member; a means for activating and deactivating the shock-absorbing member and adapted to determine a first shock-absorbing condition and a second condition in which shock-absorbing is disabled. The movable member includes a grip body which is adapted to be gripped by a user, and the shock-absorbing member and the activation and deactivation means are arranged substantially at the grip body.

18 Claims, 3 Drawing Sheets

STICK WITH SHOCK-ABSORBER

BACKGROUND OF THE INVENTION

1) Field of the Invention

The present invention relates to a stick with shock-absorber.

2) Description of the Prior Art

Trekking sticks used by hikers in order to improve their stability, especially on rough terrain, by providing an additional support, are known. These sticks are adapted to cushion the impacts and vibrations generated by contact with the ground but, if necessary, they can be converted into fully rigid sticks which are more useful, for example, when climbing. Some of these sticks are constituted by two generally cylindrical coaxial members, one of which remains in contact with the ground, the second one being connected to the grip of the stick. The upper member ends with a central pin which has a smaller diameter than the lower member, so that it can be arranged partially in the lower member so as to allow mutual sliding, so that the entire assembly constitutes a single tube. A spring arranged around the central pin of the upper tube and contrasted by the edge of the lower tube acts as a cushioning device between the two members, allowing the stick to absorb the stresses with respect to the ground. The elongation of this telescopic system is determined by the stroke of the central pin with respect to the lower tube. Accordingly, a protrusion is provided at right angles on the pin and enters a slot which is shaped like an inverted L and is formed on the internal surface of the lower tube, constituting a guide for the protrusion and therefore a means for mutually locking the two telescopic members. By turning the two members that constitute the stick with respect to each other, the protrusion of the pin is moved along the horizontal part of the slot. At one end, the protrusion can slide along the longer vertical side of the L-shaped slot, thus allowing the pin to slide and enabling the shock-absorbing device; at the other end, the protrusion is locked and the shock-absorbing device is disabled.

These devices have the drawback that they are particularly heavy due to the central pin; moreover, the weight produces an unfavorable leverage for the user's wrist.

Another drawback consists of the fact that dust and moisture, by penetrating in the region where the shock-absorbing system is arranged, tend to compromise its correct operation.

Another disadvantage is constituted by the high cost due to the components and their assembly.

Other conventional trekking sticks are constituted by a single cylindrical body, which constitutes the stick itself and at the top of which a contrast disk is applied, and by a grip, which is coaxial to the stick and can slide along it. The stroke of the grip is delimited by an elastic band which is applied along a guide which is formed inside the grip and is connected, by means of a hook, to the contrast disk, to which the grip adheres when the elastic band is at rest. The grip, the elastic band and the contrast disk constitute the shock-absorbing device.

These shock-absorbing systems have the drawback that it is difficult to disable the device in the grip, because it is necessary to disengage the elastic band and apply the grip to the contrast disk, this being a troublesome and slow operation.

Another disadvantage is the fact that since the shock-absorbing member is actually an elastic band, there is no preset stroke limit, except the maximum elongation of the elastic band, with the risk of forward imbalance for the user.

Another disadvantage is the upper space occupation of the grip due to the elastic band contained therein, not to mention the fact that the debris that penetrates between the grip and the contrast disk tends to prevent the operation of the device.

SUMMARY OF THE INVENTION

The aim of the present invention is to overcome the drawbacks of the prior art.

An important object of the invention is to provide a stick with shock-absorber which can be adjusted easily and simply by the user.

Another object of the invention is to provide a stick with shock-absorber which is lighter.

Another object of the invention is to provide a stick with shock-absorber which can be manufactured with lower production costs than conventional sticks.

This aim and these and other objects which will become better apparent hereinafter are achieved by a stick with shock-absorber comprising: an elongated member, which is associated with a movable member with the interposition of a shock-absorbing member; a means for activating and deactivating the shock-absorbing member and adapted to determine a first shock-absorbing condition and a second condition in which shock-absorbing is disabled, characterized in that the movable member comprises a grip body adapted to be gripped by a user and in that the shock-absorbing member and the activation and deactivation means are arranged substantially at the grip body.

BRIEF DESCRIPTION OF THE DRAWINGS

Further characteristics and advantages of the present invention will become better apparent from the following detailed description of preferred but not exclusive embodiments thereof, illustrated only by way of non-limitative example in the accompanying drawings, wherein.

DESCRIPTION OF THE PREFERRED EMBODIMENTS OF THE INVENTION

Figure 1:
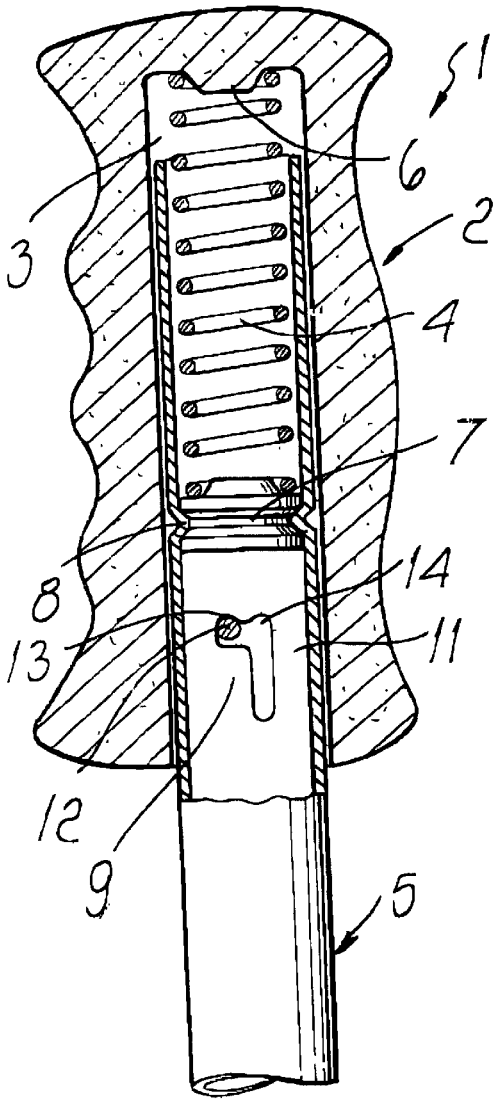
FIG. 1 is a partially sectional side view of the upper portion of the stick according to the invention, shown in the position in which the shock-absorbing system is disabled.
Figure 2:
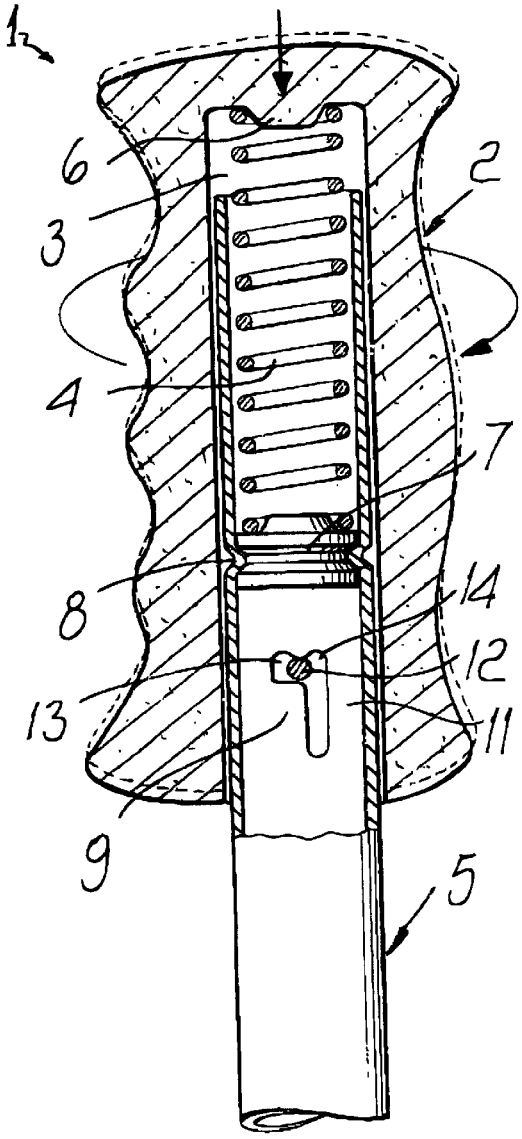
FIG. 2 is a view, similar to FIG. 1, of the stick in an intermediate position during the movement required to activate the shock-absorbing system.

With reference to the figures, the stick with shock-absorber according to the invention, generally designated by the reference numerals 1, 101, comprises an elongated member 5, 105, which constitutes the main body of the stick, and a movable member 2, 102, which is adapted to be gripped by the user.

In the specific example, the elongated member is constituted by a tube 5, 105, an upper end of which is inserted in a cavity 3, 103, formed in the movable member constituted by a grip body 2, 102, with the interposition of a flexible means 4, 104.

With particular reference to FIGS. 1 to 5, the grip body 2, which can be anatomically contoured in order to facilitate the user's grasp, as in the illustrated example, has a cylindrical cavity 3 in which the upper end of the tubular member 5 is inserted. The elastically deformable means includes a progressive spring 4 which contrasts, at one end, against a bottom or end wall 6 of the cavity 3 of the grip body 2 and, at the other end, against a disk 7 which is arranged in a narrower portion 8 of the tube 5.

The spring 4 allows to cushion the shocks generated by the impact of the tip of the stick (not shown) on the ground. The stroke of the tube 5, and therefore of the stick by way of the action of the spring, is determined by at least one shaped slot 9 and 10 which is formed in the tubular member 5 and is engaged by a pin 12 which is rigidly coupled to the movable member 2.

The pin 12 comprises, for example, an oval head 16 which engages a seat 17 of the body 2 so as to prevent the rotation of the pin with respect to the body 2, in order to prevent shearing of the pin.

Figure 3:
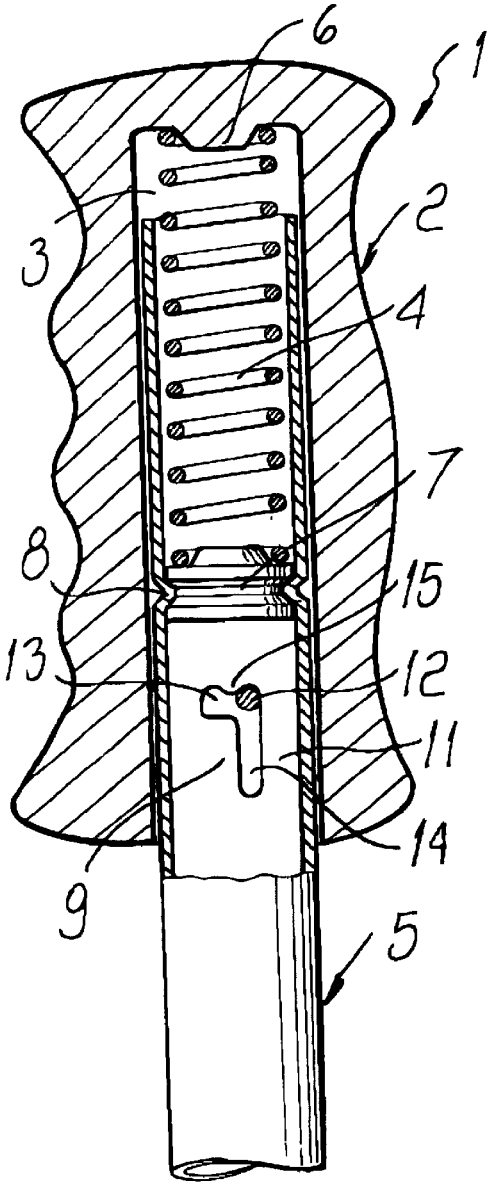
FIG. 3 is a view, similar to FIG. 2, of the stick in the condition in which the shock-absorbing system is enabled.
Figure 4:
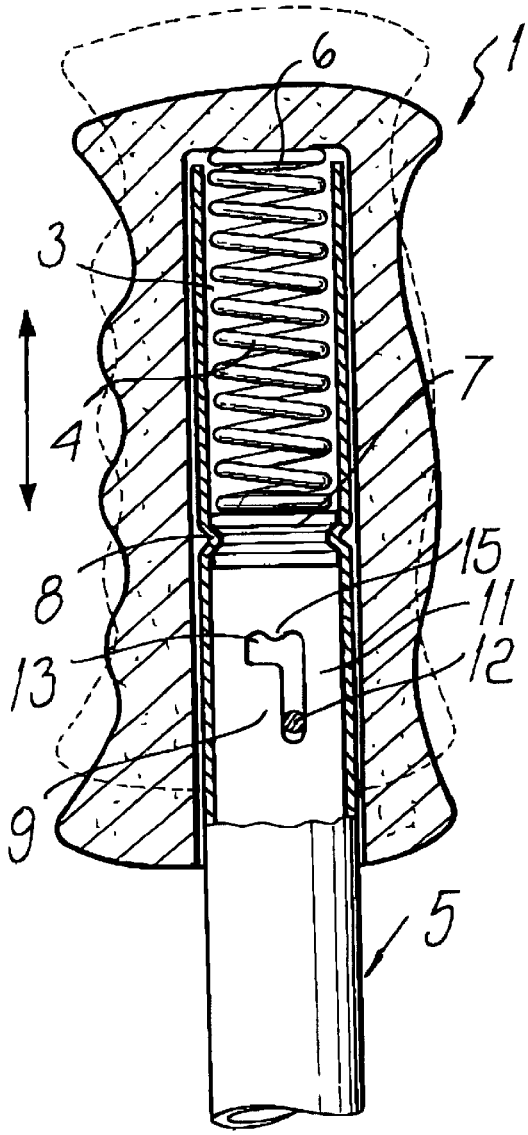
FIG. 4 is a view, similar to FIG. 3, with the shock-absorbing system in action (the spring is compressed)
Figure 5:
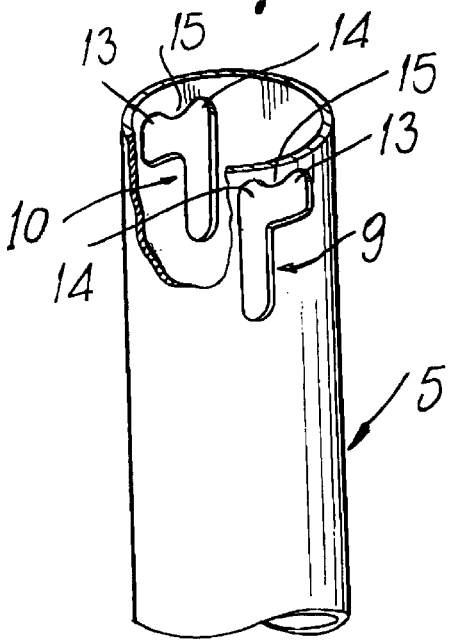
FIG. 5 is a perspective view of the detail of the slots for the sliding of the pin according to the invention.

In the illustrated example, the stick 1 comprises two slots 9, 10 which are obtained by cutting the tube 5 in the region 11 below the disk 7. Each slot 9, 10 is shaped like an inverted L, with its upper ends shaped so as to form a cam 15. In this manner, each slot 9, 10 forms a first region 14 for the free sliding of the pin and a second region 13 for limited sliding; the regions are separated by the cam 15. When the pin 12 is arranged in the second region 13, as shown in FIG. 1, which corresponds to the condition in which shock-absorbing is disabled, the tube 5 is prevented from sliding within the cavity 3 of the body 2 and the operation of the spring is thus disabled; the grip-stick assembly thus behaves like a single rigid system. By lowering and turning the grip with respect to the stick, as shown schematically in FIG. 2, the pin 12 is moved beyond the cam 15 from the second region 13 to the first region 14 of the slot 9 and 10; this position is shown in FIG. 3. In this position, the pin 12 can slide freely along the first region 14, allowing a stroke of the tube 5 inside the cavity 3 of the body 2, such that the spring 4 can cushion the forces transmitted to the stick from the ground. FIG. 4 illustrates the stroke limit position of the pin 12 in the first region 14. The sliding condition of the pin 12 in the first region 14 of the slot 9, shown in FIGS. 3 and 4, corresponds to the condition in which shock-absorbing is enabled. Whenever the user strikes the ground with the tip of the stick, the impact produces a sliding of the tube of the stick within the cavity of the grip and a consequent reaction of the spring, which tends to elongate and return the tube to the initial position. In order to deactivate the system it is sufficient to turn the knob so that the pin can move beyond the cam 15 (FIG. 2) and be arranged again in the second region 13, as shown in FIG. 1.

Cam 15 serves to inhibit a relative rotation of tube 5 and body 2 when pin 12 is located in region 13 of slots 9 and 10, thereby releasably locking tube 5 and body 2 to one another. Region 13 of slots 9 and 10 is disposed at such a position in tube 5 that when pin 12 is located in region 13, spring 4 is in a relaxed or unloaded configuration (FIG. 1) rather than a compressed or loaded configuration (FIG. 4). Slot regions 13 and 14 are straight slot segments oriented orthogonally or perpendicularly to one another. Slot regions 13 and 14 join at an interesection with a substantially sharp corner (see the end of the lead line for region 14 in FIGS. 1 and 2).

Figure 6:
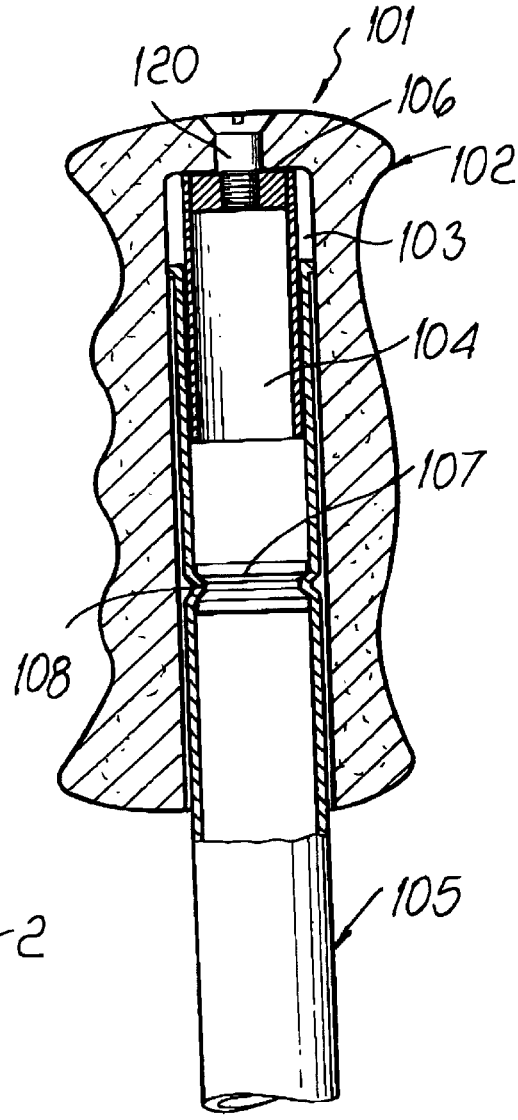
FIG. 6 is a partially sectional side view of a stick according to a further aspect of the invention.
Figure 7:
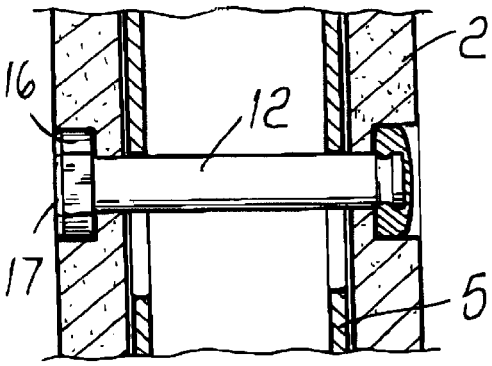
FIG. 7 is an enlarged-scale sectional view of a detail of the means for activating and deactivating the shock-absorbing member.

With reference to FIG. 6, according to another embodiment of the invention the elastically deformable means is constituted by a fluid-type shock absorber which comprises, in the illustrated example, a nitrogen-pressurized damper 104 of a per se known type.

The nitrogen-pressurized damper 104 is arranged in the cavity 103 of the grip body 102 and has a first end which, by means of a screw 120, is fastened to the bottom 106 of the cavity. The second end of the damper 104 acts in contrast with a disk 107 which is arranged in a narrower portion 108 of the tube 105.

The stroke of the tube 105 and therefore of the entire stick is determined by the mechanical characteristics of the nitrogen-pressurized piston. Activation and deactivation of the damper can be performed by means of a guide system which is similar to the one described above for the first embodiment or, as an alternative, by means of the locking/release of the passage port, which can be activated by means of an external button.

In practice it has been observed that the invention achieves the intended aim and objects, a stick with shock-absorber having been provided which is lightweight and particularly simple from the manufacturing viewpoint.

Because of the limited number of components used to provide the shock-absorbing stick according to the invention, a substantial reduction in manufacturing cost and a lower weight than conventional shock-absorbing sticks have been achieved.

Another advantage of the stick with shock-absorber according to the invention is due to the favorable weight distribution, particularly proximate to the wrist of the user.

Another advantage of the stick according to the invention is its very easy use as regards the system for enabling and disabling the shock-absorbing system.

The stick according to the invention is susceptible of numerous modifications and variations, within the scope of the appended claims. All the details may be replaced with other technically equivalent elements. The materials and the dimensions may of course be any according to requirements and to the state of the art.

What is claimed is:

1. A stick with a shock-absorber, comprising: an elongated member, which is associated with a movable member with the interposition of a shock-absorbing member; a means for activating and deactivating said shock-absorbing member and adapted to determine a first shock-absorbing condition and a second condition in which shock-absorbing is disabled, said movable member comprising a grip body adapted to be gripped by a user, said shock-absorbing member and said activation and deactivation means being arranged substantially at said grip body, said activation and deactivation means including at least one slot formed in one of said elongated member and said movable member and further including a pin rigidly coupled to the other of said elongated member and said movable member, said pin traversing said slot, said slot including a first region in which said pin slides freely to accommodate relative motion of said elongated member and said movable member and a second region in which sliding of said pin is limited and relative motion of said elongated member and said movable member is substantially prevented, said slot being provided between said first region and said second region with a cam for inhibiting a relative rotation of said elongated member and said movable member and thereby releasably locking said activation and deactivation means in said second condition.

2. The stick according to claim 1, wherein said grip body has a cavity accommodating an end portion of said elongated member and said shock-absorbing member, which acts by contrast between an end wall of said cavity and said end portion.

3. The stick according to claim 2, wherein said end portion of said elongated member is tubular and at least partially accommodates said shock-absorbing member.

4. The stick according to claim 3, wherein said end portion of said elongated member comprises an abutment member engaging an end of said shock-absorbing member.

5. The stick according to claim 3, wherein said abutment member is constituted by a disk which is arranged in a narrower portion formed in said end portion of said elongated member.

6. The stick according to claim 1, wherein said shock-absorbing member is constituted by an elastic body.

7. The stick according to claim 1, wherein said shock-absorbing member is constituted by a progressive helical spring.

8. The stick according to claim 1, wherein said shock-absorbing member is constituted by a molded spring made of polyurethane.

9. The stick according to claim 1, wherein said slot is one of two slots which are formed in diametrically opposite positions in an end portion of said elongated member and are engaged by said pin which is rigidly coupled to said movable member.

10. A stick with a shock-absorber, comprising: an elongated member, which is associated with a movable member with the interposition of a shock-absorbing spring member having a loaded or compressed configuration and an unloaded or relaxed configuration; a means for activating and deactivating said shock-absorbing spring member and adapted to determine a first shock-absorbing condition and a second condition in which said shock-absorbing spring member has said unloaded or relaxed configuration and in which shock-absorbing is disabled, said movable member comprising a grip body adapted to be gripped by a user, said shock-absorbing spring member and said activation and deactivation means being arranged substantially at said grip body.

11. The stick according to claim 10, wherein said activation and deactivation means includes at least one slot formed in one of said elongated member and said movable member and further including a pin rigidly coupled to the other of said elongated member and said movable member, said pin traversing said slot, said slot including a first region in which said pin slides freely to accommodate relative motion of said elongated member and said movable member and a second region in which sliding of said pin is limited and relative motion of said elongated member and said movable member is substantially prevented.

12. The stick according to claim 11, wherein said slot is one of two slots which are formed in diametrically opposite positions in an end portion of said elongated member and are engaged by said pin which is rigidly coupled to said movable member.

13. The stick according to claim 10, wherein said spring is a helical spring.

14. The stick according to claim 13, wherein one end of said spring is seated in a cavity in said grip body and an opposite end of said spring engages an abutment on said elongated member.

15. A stick with a shock-absorber, comprising: an elongated member, which is associated with a movable member with the interposition of a shock-absorbing member; a means for activating and deactivating said shock-absorbing member and adapted to determine a first shock-absorbing condition and a second condition in which shock-absorbing is disabled, said movable member comprising a grip body adapted to be gripped by a user, said shock-absorbing member and said activation and deactivation means being arranged substantially at said grip body, said activation and deactivation means including means for releasably locking said elongated member and said movable member to one another in said second condition of said activation and deactivation means.

16. The stick according to claim 15, wherein said means for releasably locking includes a cam on one of said elongated member and said movable member.

17. The stick according to claim 16, wherein said activation and deactivation means includes a slot on said one of said elongated member and said movable member and further includes a pin rigidly coupled to the other of said elongated member and said movable member, said pin traversing said slot, said slot including a first straight region and a second straight region orthogonal to one another, said cam being provided along said slot between said first straight region and said second straight region.

18. The stick according to claim 17, wherein said first straight region and said second straight region join in an intersection with a substantially sharp corner.

* * * * *